US011987761B2

(12) United States Patent
Lennon et al.

(10) Patent No.: US 11,987,761 B2
(45) Date of Patent: May 21, 2024

(54) FUELS

(71) Applicant: Innospec Fuel Specialties LLC, Englewood, CO (US)

(72) Inventors: Jason Allen Lennon, Englewood, CO (US); David Arthur Daniels, Middletown, DE (US)

(73) Assignee: Innospec Fuel Specialties LLC, Englewood, CO (US)

( * ) Notice: Subject to any disclaimer, the term of this patent is extended or adjusted under 35 U.S.C. 154(b) by 0 days.

(21) Appl. No.: 17/959,963

(22) Filed: Oct. 4, 2022

(65) Prior Publication Data

US 2023/0108384 A1 Apr. 6, 2023

Related U.S. Application Data

(60) Provisional application No. 63/251,986, filed on Oct. 4, 2021.

(30) Foreign Application Priority Data

Oct. 15, 2021 (EP) ..... 21202995

(51) Int. Cl.
*C10L 1/14* (2006.01)
*C10L 10/16* (2006.01)

(52) U.S. Cl.
CPC ..... *C10L 1/146* (2013.01); *C10L 10/16* (2013.01); *C10L 2200/0446* (2013.01); *C10L 2270/026* (2013.01)

(58) Field of Classification Search
None
See application file for complete search history.

(56) References Cited

U.S. PATENT DOCUMENTS

| | | | | |
|---|---|---|---|---|
| 6,786,940 | B1 | 9/2004 | Wenderoth et al. | |
| 2005/0039383 | A1* | 2/2005 | Wu | C10L 1/026 44/388 |
| 2005/0126070 | A1 | 6/2005 | Krull et al. | |
| 2007/0270318 | A1 | 11/2007 | Siggelkow et al. | |
| 2008/0141582 | A1 | 6/2008 | Breakspear | |
| 2009/0188159 | A1 | 7/2009 | Eisenbeis et al. | |
| 2009/0307964 | A1* | 12/2009 | Maehling | C10L 10/00 44/329 |
| 2010/0192455 | A1 | 8/2010 | Krull et al. | |

FOREIGN PATENT DOCUMENTS

| | | | |
|---|---|---|---|
| CA | 2033829 | A | 7/1991 |
| CA | 2859182 | A | 6/2013 |
| CN | 103635498 | B | 3/2016 |
| EP | 1857528 | A1 | 11/2007 |
| GB | 1193030 | A | 5/1970 |
| GB | 1244512 | A | 9/1971 |
| GB | 2211849 | A | 7/1989 |
| WO | 2009150145 | A1 | 12/2009 |
| WO | 2013075300 | A1 | 5/2013 |

OTHER PUBLICATIONS

Extended European Search Report in Application No. 21202995.3, dated Mar. 30, 2022 (9 pgs.).

* cited by examiner

*Primary Examiner* — Vishal V Vasisth
(74) *Attorney, Agent, or Firm* — Burns & Levinson LLP

(57) ABSTRACT

An additive composition for a diesel fuel, the additive composition comprising:

(i) a first additive comprising one or more of:
  (a) the reaction product of a polycarboxylic acid having at least one tertiary amino group and a primary or secondary amine;
  (b) the reaction product of an α, β dicarboxylic acid or a derivative thereof and a primary amine; and
  (c) the reaction product of a polyamine and a fatty acid; and (ii) a second additive which is a terpolymer obtained by reacting monomers of:
  (x) an α-olefin;
  (y) an ester of an unsaturated alcohol; and
  (z) a third monomer different to (x) and (y) comprising an alkene functional group.

6 Claims, No Drawings

FUELS

CROSS-REFERENCE TO RELATED APPLICATIONS

This application claims priority to and benefit of U.S. Provisional Application No. 63/251,986, filed Oct. 4, 2021, and European Application No. 21202995.3, filed Oct. 15, 2021 both of which are incorporated by reference herein in their entirety for all purposes.

The present invention relates to improvements in diesel fuel compositions and in particular to the properties of diesel fuel compositions at low temperatures.

As fuels cool crystals begin to form within the fuels. These can cause problems during storage, transportation and combustion of the fuel.

Three measurements are commonly taken to assess the low temperature performance of diesel fuel. Standardised tests have been devised to measure the temperature at which the fuel hazes (the cloud point—CP), the lowest temperature at which a fuel can flow (the pour point—PP) and the lowest temperature at which fuel flows through a filter, the cold filter plugging point—CFPP); and the changes thereto caused by additives (ΔCP, ΔPP, ΔCFPP). The standardised tests for measuring PP and, especially, CP and CFPP are among the common working tools for persons skilled in the art.

A standard test used to measure the pour point of diesel fuels is ASTM D5949.

The cloud point (CP) of a fuel is the temperature at which a cloud of wax crystals first appears in a liquid when it is cooled under conditions prescribed in the test method as defined in ASTM D2500 or ASTM D5773.

At temperatures below the cloud point but above the pour point, the wax crystals can reach a size and shape capable of plugging fuel lines, screens, and filters even though the fuel will physically flow. These problems are well recognized in the art and have a number of recognised test methods such as the CFPP value (cold filter plugging point, determined in accordance with DIN EN116 or ASTM D6371).

Tests such as these were introduced to give an indication of low temperature operability as the cloud point test was considered to be too pessimistic.

Cold flow improvers (CFIs) and wax anti-settling additives (WASAs) have been developed to ameliorate the problems of wax precipitation below the cloud point in fuels, and their effect can studied by the test methods described above, comparing the results between unadditised fuels and additised fuels.

Some such additives may assist in keeping the so-called "waxes" in solution in the fuel; others may alter their crystal morphology or size, so that filterability and pourability are maintained in spite of precipitation.

Another less commonly used test is the low temperature flow test (or LIFT test). This test uses a finer filter than the CFPP test and is thus more sensitive to wax blockages. The LIFT test is favoured in countries where winter temperatures can be very low, for example Canada, Scandinavia, Russia, Eastern Europe and Northern U.S.A. including Alaska.

In recent years environmental pressures have meant that greener alternatives to fossil fuels have been increasingly used. It is now common to replace some or all of diesel obtained from petroleum sources with diesel obtained from natural or renewable sources. However inclusion of a biodiesel and/or renewable diesel component can have a significant impact on the properties of a fuel at low temperatures.

The chemical nature of biodiesel and renewable diesel is quite different to that of mineral diesel. Mineral diesel is derived from petroleum and comprises a mixture of alkanes comprising a high degree of branching, along with aromatic and olefinic compounds. Biodiesel comprises fatty acid methyl esters, often with a degree of unsaturation. The presence of the ester functional groups means that these are chemically distinct from many of the compounds commonly found in mineral diesel.

Renewable diesel is prepared by the hydrodeoxygenation of fats and oils and comprises primarily straight chain alkanes. These again have a different chemical composition to mineral diesel.

Because the chemical nature of biodiesel and renewable diesel differs to that of mineral diesel, different waxes and precipitates form as these fuels cool. For blended fuels the wax crystals which form in one component may be less soluble in other components of the fuel. This can lead to increased problems, for example with filterability of the fuel, at low temperatures.

Due to the different compositions of these fuels, additives which improve the low temperature properties of mineral diesel fuels do not necessarily improve the low temperature properties of diesel fuels comprising biodiesel and/or renewal diesel components.

As mentioned above the low temperature flow test (LTFT) is an important test for assessing the low temperatures properties of fuels. It would be desirable to provide an additive which provides good performance in this test in both mineral diesel fuels and in fuels which contain a biodiesel and/or a renewable diesel component.

The present inventors have surprisingly found that a particular combination of additives is especially effective at improving the low temperature properties of diesel fuels, including blends comprising mineral diesel and biodiesel and/or renewable diesel. In particular the additive combination provides improved performance in the LTFT test.

According to a first aspect of the present invention there is provided an additive composition for a diesel fuel, the additive composition comprising:

- a first additive (i) comprising one or more of:
  - (a) the reaction product of a polycarboxylic acid having at least one tertiary amino group and a primary or secondary amine;
  - (b) the reaction product of an α, β dicarboxylic acid or a derivative thereof and a primary amine; and
  - (c) the reaction product of a polyamine and a fatty acid; and
- a second additive (ii) which is a terpolymer obtained by reacting monomers of:
  - (x) an α-olefin;
  - (y) an ester of an unsaturated alcohol; and
  - (z) a third monomer different to (x) and (y) comprising an alkene functional group.

The additive composition of the first aspect of the present invention comprises a first additive and a second additive.

The first additive (i) comprises one or more of

- (a) the reaction product of a polycarboxylic acid having at least one tertiary amino group and a primary or secondary amine;
- (b) the reaction product of an α, β dicarboxylic acid or a derivative thereof and a primary amine; and
- (c) the reaction product of a polyamine and a fatty acid.

Additives of this type are known in the art as wax anti setting additives (WASAs). In some embodiments the first additive comprises (a) the reaction product of a polycarboxylic acid having at least one tertiary amino group and a primary or secondary amine.

The polycarboxylic acid having at least one tertiary amino group preferably has 2 to 20 carbon atoms, at least one tertiary amino group and 2 to 12 carboxylic acid groups. Each carboxylic acid group in the polycarboxylic acid preferably has from 2 to 10 carbon atoms. The polycarboxylic acid groups may be the same or different. Preferably each carboxylic acid group is an acetic acid group. The polycarboxylic acid preferably has from 1 to 3 tertiary amino groups and from 2 to 8 carboxylic acid groups. In preferred embodiments the polycarboxylic acid has 3 to 5, preferably 3 or 4 carboxylic acid groups and 1 to 3, preferably 1 or 2 tertiary amino groups.

In some preferred embodiments the polycarboxylic acid has the formula (I) or (II):

(I)

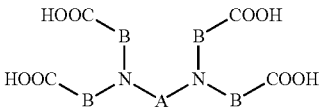

(II)

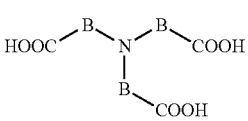

wherein A is a straight chain or branched $C_2$-$C_6$ alkylene group or HOOC—B—$N(CH_2CH_2)_2$ and B is a $C_1$ to $C_{19}$ alkylene group.

Preferably A has 2 to 4 carbon atoms, more preferably 2 or 3 carbon atoms, most preferably 2 carbon atoms.

Preferably B has 1 to 10, more preferably 1 to 4 carbon atoms.

Preferred carboxylic acids used to prepare additive (a) include nitrilotriacetic acid, ethylenediamine tetraacetic acid and propylene-1,2-diamine tetraacetic acid.

To form additive (a) the polycarboxylic acid is reacted with a primary or secondary amine. Most preferably the polycarboxylic acid is reacted with a secondary amine, preferably a secondary amine of formula $HNR_2$ in which each R is independently a straight chain or branched $C_{10}$ to $C_{30}$ alkyl or alkenyl group, preferably a $C_{14}$ to $C_{24}$ alkyl or alkenyl group. Preferably each R is an alkyl group. Preferably each R is the same.

The secondary amines may react with the polycarboxylic acid to form an amide and/or an ammonium salt. In preferred embodiments all of the amines react to form amides.

Preferred amines for reaction with the polycarboxylic acid include dioleylamine, dipalmitamine, dicoconut fatty amine, distearylamine, dibehenyl amine and hydrogenated and/or unhydrogenerated ditallow fatty amine. Ditallow fatty amine is especially preferred.

Preferably the amines are reacted with the carboxylic acid in a ratio of from 0.5 to 1.5, preferably from 0.8 to 1.2 moles of amine per carboxylic group present in the carboxylic acid.

An especially preferred additive component (a) is the reaction product of 1 mole of ethylenediamine tetraacetic acid and 4 moles of hydrogenated tallow fatty amine.

Other preferred compounds of this type include the N, N dialkyl ammonium salts of 2-N-,N' dialkylamidobenzoates, for example the reaction product of 1 mole of phthalic anhydride with 2 moles of ditallow fatty amine and the reaction product of 1 mole of alkenyl-spiro-bislactone with 2 moles of a dialkylamine, for example ditallow fatty amine (hydrogenated or un hydrogenated).

In some embodiments the first additive comprises (b) the reaction product of an α, β unsaturated dicarboxylic acid or a derivative thereof and a primary amine. The skilled person will appreciate that such reaction products may comprise one or two amides, an imide, a salt or a mixture thereof.

Preferred α, β dicarboxylic acids for use in preparing additives (b) include succinic acid, maleic acid, fumaric acid, itaconic acid and derivatives thereof. Such acids may be substituted. By derivatives of α, β dicarboxylic acid we mean to include carbonyl halides, carboxylic esters and carboxylic anhydrides. In some preferred embodiments the α, β dicarboxylic acid derivative is an anhydride. Most preferably component (b) is the reaction product of maleic anhydride and a primary amine.

Preferred primary amines for reaction with the α, β unsaturated dicarboxylic acid are alkyl, alkenyl, aryl, alkaryl or aralkyl amines, preferably having 8 to 30, more preferably 12 to 22 carbon atoms. Preferred amines are alkyl or alkenyl amines. The alkyl or alkyl chain may be straight-chained or branched, saturated or unsaturated. A mixture of alkyl or alkenyl amines may be used. The skilled person will appreciate that commercial sources of such amines often comprise a mixture of isomers and/or a mixture of homologues. In some preferred embodiments natural sources of fatty amines are used for example coconut amine, tallow fatty amine, hydrogenated tallow fatty amine, oleyl amine, arachidyl amine and behenyl amine.

Additive component (b) preferably comprises a monoamide or bisamide of maleic acid. Component (b) may also comprise minor amounts of the ammonium salt.

In one preferred embodiment component (b) comprises the reaction product of 1 mole of maleic anhydride and 1 mole of a $C_{13}$ alkyl amine.

In some embodiments the first additive may comprise (c) the reaction product of a polyamine and a fatty acid.

Preferred polyamines are polyethylene polyamines. Examples of suitable polyamines which may be used to prepare the amines of component (c) include ethylenediamine, diethylene triamine, triethylenetetraamine, tetraethylenepentamine, pentaethylenehexamine, dipropylenetriamine, tripropylenetetramine, tetrapropylenepentamine, pentapropylenehexamine, polyethylene imines having a mean degree of polymerisation (numbers of nitrogen atoms) of 10, 35, 50 or 100 and polyamines obtained by reacting a oligoamines with acrylonitrile and subsequent hydrogenation, for example N, N'bis-(3-amino propyl) ethylene diamine.

Suitable fatty acids for reaction with the polyamines include pure fatty acids and commercial sources comprising mixtures of fatty acids including, for example, stearic acid, palmitic acid, lauric acid, oleic acid, linolic acid and linoleic acid. Especially useful for preparing component (c) are mixtures of naturally occurring fatty acids, for example tallow fatty acid, coconut fatty acid, fish oil fatty acid, coconut palm kernel oil fatty acid, soybean oil fatty acid, colza oil fatty acid, peanut oil fatty acid and palm oil fatty acid. Compounds including monoesters of long chain alcohols and dicarboxylic acids can also be used as the fatty acid component.

Preferably component (c) is prepared from polyethylene polyamines having 2 to 6 nitrogen atoms and fatty acids having 16 to 20 carbon atoms.

In one preferred embodiment component (c) comprises the reaction product of 3 moles of oleic acid with 1 mole of diethylenetriamine.

In some embodiments the first additive comprises component (a).

In some embodiments the first additive comprises component (b).

In some embodiments the first additive comprises component (c).

In some embodiments the first additive comprises component (a) and component (b).

In some embodiments the first additive comprises component (a) and component (c).

In some embodiments the first additive comprises component (b) and component (c).

In some especially preferred embodiments the first additive comprises component (a), component (b) and component (c).

In one preferred embodiment the first additive (i) comprises from 40 to 90 wt %, preferably 50 to 85 wt %, more preferably 55 to 75 wt %, for example from 60 to 70 wt % of component (a); from 1 to 30 wt %, preferably 1 to 25 wt %, preferably 5 to 20 wt %, for example from 10 to 20 wt % of component (b); and from 5 to 50 wt %, preferably 10 to 40 wt %, preferably 15 to 35 wt %, for example from 20 to 30 wt % of component (c).

For the avoidance of doubt the above amounts refer to the total amount of each of components (a), (b) or (c) present in the composition and do not include any solvent or diluent.

In a preferred embodiment the weight ratio of component (a) to the sum of component (b) and component (c) is preferably from 5:1 to 1:1, preferably from 4:1 to 1.5:1, more preferably from 3:1 to 2:1.

Suitable additives for use as the first additive (i) are described in US2009/0188159.

In preferred embodiments the first additive (i) comprises:

(a) the reaction product of a polycarboxylic acid having 2 to 20 carbon atoms, 1 to 3 tertiary amino groups and 3 to 5 carboxylic acid groups and a secondary amine of formula $HNR_2$ in which each R is independently a straight chain or branched $C_{10}$ to $C_{30}$ alkyl or alkenyl group;

(b) the reaction product of succinic acid, maleic acid, fumaric acid or a derivatives thereof and an alkyl or alkenyl amine having 12 to 22 carbon atoms; and (c) the reaction product of a polyethylene polyamine and a fatty acid selected from stearic acid, palmitic acid, lauric acid, oleic acid, linolic acid, linoleic acid, tallow fatty acid, coconut fatty acid, fish oil fatty acid, coconut palm kernel oil fatty acid, soybean oil fatty acid, colza oil fatty acid, peanut oil fatty acid and palm oil fatty acid.

In preferred embodiments the first additive (i) comprises:

(a) the reaction product of a carboxylic acid selected from nitrilotriacetic acid, ethylenediamine tetraacetic acid and propylene-1,2-diamine tetraacetic acid and an amine selected from dioleylamine, dipalmitamine, dicoconut fatty amine, distearylamine, dibehenyl amine, ditallow fatty amine and hydrogenated ditallow fatty amine;

(b) the reaction product of maleic anhydride and an amine selected from coconut amine, tallow fatty amine, oleyl amine, arachidyl amine, tridecyl amine and behenyl amine; and (c) the reaction product of polyethylene polyamines having 2 to 6 nitrogen atoms and fatty acids having 16 to 20 carbon atoms.

The additive composition of the first aspect of the present invention comprises a second additive (ii) which is a terpolymer obtained by reacting monomers of (x) an α-olefin; (y) an ester of an unsaturated alcohol; and (z) a third monomer different to (x) and (y) comprising an alkene functional group.

Each of monomers (x), (y) and (z) may comprise a mixture of compounds, for example a mixture of isomers and/or a mixture of homologues.

Monomer component (x) is an α-olefin. Suitable α-olefins include ethylene, propylene, 1-butene, 1-pentene, 1-hexene, 1-heptene, 1-octene, 1-nonene, 1-decene and higher monounsaturated homologues having up to 40 carbon atoms. Preferably the α-olefin component (x) is selected from ethylene, propylene and 1-butene, more preferably from ethylene and propylene. Most preferably component (x) comprises ethylene.

Monomer (y) is the ester of an unsaturated alcohol. The term unsaturated alcohol is meant to refer to an alcohol including a double bond. Preferably the alcohol includes a single double bond. Preferably the double bond is adjacent to the hydroxy functional group. In preferred embodiments the ester of an unsaturated alcohol is a vinyl ester.

Preferred esters are esters of $C_1$ to $C_{20}$ carboxylic acids, especially vinyl esters of acetic acid, propionic acid, butyric acid, valeric acid, isovaleric acid, pivalic acid, caproic acid, enanthic acid, caprylic acid, pelargonic acid, neononanoic acid, neodecanoic acid, capric acid, lauric acid, mynistic acid, palmitic acid, stearic acid and arachic acid. Propenyl esters of such acids could also be used.

In particular preferred embodiments the monomer (y) is a vinyl ester of acetic acid, also referred to as vinyl acetate.

Monomer component (z) comprises a third monomer which is different to (x) and (y) and which comprises an alkene functional group. By this we mean that monomer (z) comprises a double bond. Preferably monomer (z) comprises a single double bond.

In some embodiments monomer (z) comprises an ester including a double bond. The double bond may be present in the alcohol derived portion of the ester or in the acid derived portion of the ester.

In some embodiments (z) may comprise an alkene. In some embodiments (z) may comprise an ester of an unsaturated alcohol which is different to monomer (x).

Preferably monomer (z) is selected from:

an alkene, especially an α-olefin;

an α, β unsaturated carboxylic acid or an ester thereof; and an ester of an unsaturated alcohol.

In some embodiments the polymer may be prepared from a mixture of monomers (z).

In some embodiments monomer (z) comprises an alkene, especially an α-olefin which is different to component (x). Suitable α-olefins include propylene, 1-butene, 1-pentene, 1-hexene, 1-heptene, 1-octene, 1-nonene, 1-decene and higher monounsaturated homologues having up to 40 carbon atoms.

In one preferred embodiment where component (x) comprises ethylene, component (z) comprises propylene.

In some embodiments components (z) comprises an α, β unsaturated carboxylic acid or an ester thereof. Preferred monomers are esters of an α, β unsaturated carboxylic acid. Suitable α, β unsaturated acids which may be used to prepare monomer (z) include acrylic acid, methacrylic acid, crotonic acid and isocrotonic acid. Preferred monomers are esters of such acids and $C_1$ to $C_{20}$ alcohols.

In some preferred embodiments the monomer (z) is selected from methyl acrylate, ethyl acrylate, propyl acrylate, isopropyl acrylate, n-butyl acrylate, isobutyl acrylate, tert-butyl acrylate, n-pentyl acrylate, neopentyl acrylate, heptyl acrylate, octyl acrylate, neooctyl acrylate, 2-ethylhexyl acrylate, nonyl acrylate, neononyl acrylate, decyl acrylate, neodecyl acrylate, lauryl acrylate, palmityl acrylate and stearyl acrylate.

Preferred monomers (z) include methyl acrylate and 2-ethylhexyl acrylate.

In one preferred embodiment component (z) comprises 2-ethylhexyl acrylate.

In some embodiments component (z) comprises an ester of an unsaturated alcohol which is different to monomer (y).

In such embodiments component (z) is preferably a vinyl ester of a fatty acid having linear or branched alkyl groups having 1 to 30 carbon atoms and especially having 1 to 18 carbon atoms. Examples include vinyl acetate, vinyl propionate, vinyl butyrate, vinyl hexanoate, vinyl heptanoate, vinyl octanoate, vinyl laurate and vinyl stearate, and also esters of vinyl alcohol based on branched fatty acids, such as vinyl isobutyrate, vinyl pivalate, vinyl 2-ethylhexanoate, vinyl isononanoate, vinyl neononanoate, vinyl neodecanoate and vinyl neoundecanoate.

In one preferred embodiment component (z) comprises a vinyl ester of neononanoic acid.

Some preferred terpolymers for use as the second additive (ii) are formed from ethylene, vinyl acetate and vinyl neononanoate or from ethylene, vinyl acetate and vinyl neodecanoate or from ethylene, vinyl acetate and vinyl neoundecanoate or from ethylene, vinyl acetate and vinyl 2-ethylhexanoate. Particularly preferred terpolymers of vinyl neononanoate, of vinyl neodecanoate, of vinyl neoundecanoate and of vinyl 2-ethylhexanoate contain, apart from ethylene, 7.7 to 15.9 mol %, particularly 9.5 to 15.4 mol % and especially 10.0 to 15.0 mol %, for example 10.5 to 15.0 mol % of vinyl acetate and 0.1 to 6 mol %, particularly 0.2 to 5 mol % and especially 0.3 to 5 mol % of the respective long-chain vinyl ester, where the total comonomer content is between 8.0 and 16.0 mol %, particularly between 10.0 and 15.5 mol % and especially between 10.5 and 15.0 mol %, for example between 10.5 and 14.5 mol %.

(Meth)acrylic esters suitable as comonomers are esters of acrylic acid and methacrylic acid and preferably those having 1 to 20 carbon atoms in the alkyl radical, such as methyl (meth)acrylate, ethyl (meth)acrylate, n- and isopropyl (meth)acrylate, n- and isobutyl (meth)acrylate, hexyl, octyl, 2-ethylhexyl, decyl, dodecyl, tetradecyl, hexadecyl, octadecyl (meth)acrylate. Also suitable are mixtures of two, three, four or more of these comonomers. In a preferred embodiment, terpolymers of ethylene, a vinyl ester and a (meth)acrylic ester, for example terpolymers of ethylene, vinyl acetate and methyl acrylate, of ethylene, vinyl acetate and isobutyl acrylate or of ethylene, vinyl acetate and 2-ethylhexyl acrylate may be used. Particularly preferred terpolymers contain, apart from ethylene, 1 to 20 mol %, particularly 2 to 18 mol % and especially 5 to 15 mol %, for example 8 to 12 mol % of vinyl acetate and 0.1 to 10 mol %, particularly 2 to 8 mol % and especially 4 to 6 mol % of the particular (meth)acrylic ester, where the total comonomer content is between 5 and 30 mol %, particularly between 10 and 20 mol % and especially between 12 and 18 mol %, for example between 13 and 17 mol %.

Further preferred terpolymers contain, as well as ethylene and 8.0 to 17 mol %, more preferably 10 to 16.0 mol % and especially 10.5 to 15.5 mol %, for example 10.5 to 15.0 mol %, of one or more vinyl esters, also 0.1 to 5 mol % and preferably 0.2 to 4 mol % of one or more olefins having 3 to 8 carbon atoms, for example propene, butene, isobutylene, hexene, 4-methylpentene, octene, diisobutylene and/or norbornene, in which case the molar content thereof is subtracted from the molar ethylene content. A preferred olefin is propene. Particularly preferred terpolymers of ethylene, one or more vinyl esters and propene have 0.5 to 4.0 methyl groups derived from propene per 100 aliphatic carbon atoms. The number of methyl groups derived from propene (propene $CH_3$) per 100 aliphatic carbon atoms is determined by means of $^{13}C$ NMR spectroscopy.

The terpolymers (ii) preferably have number-average molecular weights Mn between 1000 and 7000 g/mol and especially between 1200 and 5000 g/mol. The weight-average molecular weight is preferably between 2000 and 20 000 g/mol, more preferably between 3000 and 15 000 g/mol and especially between 3500 and 12 000 g/mol, in each case determined by means of gel permeation chromatography (GPC) in THF against poly(styrene) standards. The molecular weight of the terpolymers (ii) can also be characterized via their melt viscosity; the melt viscosity of preferred terpolymers (ii) measured at 140° C. (without solvent) is preferably between 20 and 5000 mPas, particularly between 30 and 2000 mPas and especially between 50 and 1500 mPas.

Some preferred terpolymers for use as the second additive (ii) include terpolymers of ethylene, vinyl acetate and propene; of ethylene, vinyl neononanoate and propene; of ethylene, vinyl neodecanoate and propene; of ethylene, vinyl 2-ethylhexanoate and propene; and of ethylene, vinyl acetate and 2-ethylhexylacrylate.

Most preferably the second additive (ii) comprises a terpolymer of ethylene, vinyl acetate and 2-ethylhexylacrylate, preferably prepared from 80 to 90 mol % ethylene, 5 to 15 mol % vinyl acetate and 2 to 8 mol % 2-ethylhexyl acrylate.

Preferred second additives (ii) include the polymers described in U.S. Pat. No. 7,713,316, US66306186, U.S. Pat. No. 8,642,521, US78115697 and US2017/0233670.

The additive composition of the first aspect of the present invention may comprise one or more further additives, for example any additive commonly known for use in diesel compositions.

Suitable additives will be known to the person skilled in the art. In particular the additive composition of the first aspect may further comprise a nitrogen containing detergent. Suitable nitrogen containing detergents are described in relation to the second aspect. The amount of detergent included in the additive composition will be determined based on the desired concentration in the formulated diesel fuel composition.

The additive composition of the first aspect of the present invention may further comprise a diluent or carrier. Suitable diluents and carriers will be known to the person skilled in the art and include for example aromatic solvents. Suitable solvents include xylene, naphthalene, mixtures of aromatic solvents, toluene, white spirits, Shellsol®, Exxsol® and polar organic solvents, especially 2-ethyl hexanol, decanol and tridecanol. Preferred diluents include xylene, naphthalene and mixtures of aromatic solvents.

Preferably the additive composition comprises from 0.1 to 30 wt % additive (i) and from 0.1 to 60 wt % additive (ii) preferably from 0.5 to 10 wt % additive (i) and from 25 to 50 wt % additive (ii).

Preferably the weight ratio of the first additive (i) to the second additive (ii) is from 10:1 to 1:100, preferably from 1:1 to 1:20, more preferably from 1:2 to 1:10.

According to a second aspect of the present invention there is a provided a diesel fuel composition comprising a major proportion of a diesel fuel and:

a first additive (i) comprising one or more of:

(a) the reaction product of a polycarboxylic acid having at least one tertiary amino group and a primary or secondary amine;

(b) the reaction product of an α, β dicarboxylic acid or a derivative thereof and a primary amine; and (c) the reaction product of a polyamine and a fatty acid; and a second additive (ii) which is a terpolymer obtained by reacting monomers of:

(x) an α-olefin;

(y) an ester of an unsaturated alcohol; and (z) a third monomer different to (x) and (y) comprising an alkene functional group.

Preferred features of the second aspect are as defined in relation to the first aspect. In particular the first additive (i) and second additive (ii) are as defined in the first aspect.

The diesel fuel composition of the second aspect comprises a diesel fuel. Suitably the diesel fuel is a middle distillate fuel, generally boiling within the range of from 110 to 500, e.g. 150 to 400° C. Preferably it is a fuel for use in diesel engines or heating fuel oil.

Preferably the diesel fuel is a low sulphur content fuel, preferably having a sulphur content less than 200 ppm, preferably less than 100 ppm, preferably less than 50 ppm, preferably less than 20 ppm, preferably less than 15 ppm, preferably less than 10 ppm.

The diesel fuel composition of the second aspect of the present invention comprises a major proportion of a diesel fuel.

By diesel fuel we mean any fuel suitable for use in a diesel engine, either for road use or non-road use. This includes but is not limited to fuels described as diesel, marine diesel, heavy fuel oil, industrial fuel oil, etc.

The diesel fuel composition used in the present invention may comprise a petroleum-based fuel oil, especially a middle distillate fuel oil. Such distillate fuel oils generally boil within the range of from 110° C. to 500° C., e.g. 150° C. to 400° C. The diesel fuel may comprise atmospheric distillate or vacuum distillate, cracked gas oil, or a blend in any proportion of straight run and refinery streams such as thermally and/or catalytically cracked and hydro-cracked distillates.

The diesel fuel composition may comprise non-renewable Fischer-Tropsch fuels such as those described as GTL (gas-to-liquid) fuels, CTL (coal-to-liquid) fuels and OTL (oil sands-to-liquid).

In preferred embodiments the diesel fuel present in the diesel fuel composition of the second aspect comprises mineral diesel and one or more further components selected from biodiesel, renewable diesel and mixtures thereof.

In some embodiments the diesel fuel comprises mineral diesel and biodiesel.

In some embodiments the diesel fuel comprises mineral diesel and renewable diesel.

In some embodiments the diesel fuel comprises mineral diesel, biodiesel and renewable diesel.

By mineral fuels herein we mean fuels derived wholly from mineral (i.e. petroleum) sources.

In this specification by biodiesel we mean to refer to esters of fatty acids. Such fuels are commonly referred to as first generation biodiesel. Biodiesel as defined herein contains esters of, for example, vegetable oils, animal fats and used cooking fats. This form of biodiesel may be obtained by transesterification of oils, with an alcohol, usually a mono-alcohol, usually in the presence of a catalyst. The fatty acids used to produce the fuel may originate from a wide variety of natural sources including, but not limited to, vegetable oil, canola oil, safflower oil, sunflower oil, nasturtium seed oil, mustard seed oil, olive oil, sesame oil, soybean oil, corn oil, peanut oil, cottonseed oil, rice bran oil, babassu nut oil, castor oil, palm oil, rapeseed oil, low erucic acid rapeseed oil, palm kernel oil, lupin oil, jatropha oil, coconut oil, flaxseed oil, evening primrose oil, jojoba oil, camelina oil, tallow, beef tallow, butter, chicken fat, lard, dairy butterfat, shea butter, used frying oil, oil miscella, used cooking oil, yellow trap grease, hydrogenated oils, derivatives of the oils, fractions of the oils, conjugated derivatives of the oils, and mixtures of any thereof.

The diesel fuel composition may comprise renewable diesel. In this specification by renewable diesel we mean to refer to diesel fuel obtained by the hydrodeoxygenation of fats and oils. Such fuels are often referred to as second generation biodiesel and are derived from renewable resources such as vegetable oils and animal fats and processed, often in the refinery, using, for example, hydroprocessing such as the H-Bio process developed by Petrobras. Second generation biodiesel is marketed by ConocoPhillips as Renewable Diesel and by Neste as NExBTL.

The diesel fuel composition may comprise one or more further components, for example the fuels referred to as third generation biodiesel. Third generation biodiesel utilises gasification and Fischer-Tropsch technology including those described as BTL (biomass-to-liquid) fuels. Third generation biodiesel does not differ widely from some second generation biodiesel, but aims to exploit the whole plant (biomass) and thereby widens the feedstock base.

In some embodiments the diesel fuel composition may comprise a pyrolysis fuel oil, for example plastic pyrolysis oil or a biomass (wood, vegetable oil, algae) pyrolysis oil.

The diesel fuel composition may contain blends of any or all of the above diesel fuel compositions.

In some embodiments the diesel fuel composition may be a blended diesel fuel comprising biodiesel. In such blends the biodiesel may be present in an amount of (by volume), for example up to 0.5%, up to 1%, up to 2%, up to 3%, up to 4%, up to 5%, up to 10%, up to 20%, up to 30%, up to 40%, up to 50%, up to 60%, up to 70%, up to 80%, up to 90%, up to 95% or up to 99%.

In some embodiments the fuel composition may comprise neat biodiesel.

A fuel which comprises 100% biodiesel is denoted as B100, a fuel which comprises 90% mineral diesel and 10% biodiesel (by volume) is known as B10; fuel comprising 50% mineral diesel and 50% biodiesel (by volume) is known as B50; and so on.

In some embodiments the diesel fuel composition may be a blended diesel fuel comprising renewable diesel. In such blends the renewable diesel may be present in an amount of (by volume), for example up to 0.5%, up to 1%, up to 2%, up to 3%, up to 4%, up to 5%, up to 10%, up to 20%, up to 30%, up to 40%, up to 50%, up to 60%, up to 70%, up to 80%, up to 90%, up to 95% or up to 99%.

In some embodiments the fuel composition may comprise neat renewable diesel.

A fuel which comprises 100% renewable diesel is denoted as R100, a fuel which comprises 90% mineral diesel and 10% renewable diesel (by volume) is known as R10; fuel comprising 50% mineral diesel and 50% renewable diesel (by volume) is known as R50; and so on.

In preferred embodiments the diesel fuel present in the diesel fuel composition of the second aspect comprises mineral diesel and one or more further components selected from biodiesel, renewable diesel and mixtures thereof.

In some embodiments the diesel fuel comprises mineral diesel and at least 5 vol % of a fuel selected from biodiesel, renewable diesel and mixtures thereof.

In some embodiments the diesel fuel comprises mineral diesel and at least 5 vol % biodiesel.

In some embodiments the diesel fuel comprises mineral diesel and at least 5 vol % renewable diesel.

In some embodiments the diesel fuel comprises mineral diesel and from 1 to 30 vol %, preferably from 1 to 20 vol %, more preferably from 1 to 10 vol % of a fuel selected from biodiesel, renewable diesel and mixtures thereof.

In some embodiments the diesel fuel comprises mineral diesel and from 1 to 30 vol %, preferably from 1 to 20 vol %, more preferably from 1 to 10 vol % biodiesel.

In some embodiments the diesel fuel comprises mineral diesel and from 1 to 30 vol %, preferably from 1 to 20 vol %, more preferably from 1 to 10 vol % renewable diesel.

Suitably the first additive (i) is present in the diesel fuel composition in an amount of at least 1 ppm, preferably at least 10 ppm, more preferably at least 30 ppm, suitably at least 50 ppm.

Suitably the first additive (i) is present in the fuel composition in an amount of less than 30000 ppm, preferably less than 10000 ppm, preferably less than 5000 ppm, preferably less than 3000 ppm, for example less than 2500 ppm.

Suitably the first additive (i) is present in the fuel composition in an amount of from 1 to 20000 ppm, preferably 10 to 10000 ppm, more preferably 50 to 5000 ppm.

Suitably the second additive (ii) is present in the diesel fuel composition in an amount of at least 1 ppm, preferably at least 10 ppm, more preferably at least 30 ppm, suitably at least 50 ppm.

Suitably the second additive (ii) is present in the fuel composition in an amount of less than 30000 ppm, preferably less than 10000 ppm, preferably less than 5000 ppm, preferably less than 3000 ppm, for example less than 2500 ppm.

Suitably the second additive (ii) is present in the fuel composition in an amount of from 1 to 20000 ppm, preferably 10 to 10000 ppm, more preferably 50 to 5000 ppm.

In this specification any reference to ppm is to parts per million by volume. The values given in parts per million (ppm) for treat rates denote the amount of active agent present in the composition and do not include any diluent, carriers or other materials that may be present.

The diesel fuel composition of the present invention may include one or more further additives such as those which are commonly found in diesel fuels. These include, for example, antioxidants, dispersants, detergents, metal deactivating compounds, wax anti-settling agents, cold flow improvers, cetane improvers, dehazers, stabilisers, demulsifiers, antifoams, corrosion inhibitors, lubricity improvers, dyes, markers, combustion improvers, metal deactivators, odour masks, drag reducers and conductivity improvers. Examples of suitable amounts of each of these types of additives will be known to the person skilled in the art.

In some preferred embodiments the diesel fuel composition of the present invention comprises one or more further detergents. Nitrogen-containing detergents are preferred.

The one or more further detergents may be selected from:

(i) a quaternary ammonium salt additive;

(ii) the product of a Mannich reaction between an aldehyde, an amine and an optionally substituted phenol;

(iii) the reaction product of a carboxylic acid-derived acylating agent and an amine;

(iv) the reaction product of a carboxylic acid-derived acylating agent and hydrazine;

(v) a salt formed by the reaction of a carboxylic acid with di-n-butylamine or tri-n-butylamine;

(vi) the reaction product of a hydrocarbyl-substituted dicarboxylic acid or anhydride and an amine compound or salt which product comprises at least one amino triazole group;

(vii) a substituted polyaromatic detergent additive (viii) partial esters of substituted succinic acids.

Preferably one or more further detergents are selected from one or more of:

(i) a quaternary ammonium salt additive;

(ii) the product of a Mannich reaction between an aldehyde, an amine and an optionally substituted phenol; and (iii) the reaction product of a carboxylic acid-derived acylating agent and an amine.

The ratio of the additive of the present invention to the nitrogen containing detergent is suitably from 10:1 to 1:10, preferably 5:1 to 1:5, preferably from 2:1 to 1:2.

In some embodiments the diesel fuel composition further comprises (i) a quaternary ammonium salt additive.

The quaternary ammonium salt additive is suitably the reaction product of a nitrogen-containing species having at least one tertiary amine group and a quaternising agent.

The nitrogen containing species may be selected from:

(x) the reaction product of a hydrocarbyl-substituted acylating agent and a compound comprising at least one tertiary amine group and a primary amine, secondary amine or alcohol group;

(y) a Mannich reaction product comprising a tertiary amine group; and (z) a polyalkylene substituted amine having at least one tertiary amine group.

Examples of quaternary ammonium salts and methods for preparing the same are described in the following patents, which are hereby incorporated by reference, US2008/0307698, US2008/0052985, US2008/0113890 and US2013/031827.

The preparation of some suitable quaternary ammonium salt additives in which the nitrogen-containing species includes component (x) is described in WO 2006/135881 and WO2011/095819.

Component (y) is a Mannich reaction product having a tertiary amine. The preparation of quaternary ammonium salts formed from nitrogen-containing species including component (y) is described in US 2008/0052985.

The preparation of quaternary ammonium salt additives in which the nitrogen-containing species includes component (z) is described for example in US 2008/0113890.

To form the quaternary ammonium salt additive (i) the nitrogen-containing species having a tertiary amine group is reacted with a quaternising agent.

The quaternising agent may suitably be selected from esters and non-esters.

Preferred quaternising agents for use herein include dimethyl oxalate, methyl 2-nitrobenzoate, methyl salicylate and styrene oxide or propylene oxide optionally in combination with an additional acid.

An especially preferred additional quaternary ammonium salt for use herein is formed by reacting methyl salicylate or dimethyl oxalate with the reaction product of a polyisobutylene-substituted succinic anhydride having a PIB number average molecular weight of 700 to 1300 and dimethylaminopropylamine.

Other suitable quaternary ammonium salts include quaternised terpolymers, for example as described in US2011/0258917; quaternised copolymers, for example as described in US2011/0315107; and the acid-free quaternised nitrogen compounds disclosed in US2012/0010112.

Further suitable quaternary ammonium compounds for use in the present invention include the quaternary ammonium compounds described in the applicant's copending applications WO2011/095819, WO2013/017889, WO2015/011506, WO2015/011507, WO2016/016641 and PCT/GB2016/052312.

In some embodiments the diesel fuel composition used in the present invention comprises from 1 to 500 ppm, preferably 50 to 250 ppm of the additive of the present invention and from 1 to 500 ppm, preferably 50 to 250 ppm of a quaternary ammonium additive (i).

In some embodiments the diesel fuel composition comprises further (ii) the product of a Mannich reaction between an aldehyde, an amine and an optionally substituted phenol. This Mannich reaction product is suitably not a quaternary ammonium salt.

Preferably the aldehyde component used to prepare the Mannich additive is an aliphatic aldehyde. Preferably the aldehyde has 1 to 10 carbon atoms. Most preferably the aldehyde is formaldehyde.

Suitable amines for use in preparing the Mannich additive include monoamines and polyamines. One suitable monoamine is butylamine.

The amine used to prepare the Mannich additive is preferably a polyamine. This may be selected from any compound including two or more amine groups. Preferably the polyamine is a polyalkylene polyamine, preferably a polyethylene polyamine. Most preferably the polyamine comprises tetraethylenepentamine or ethylenediamine.

The optionally substituted phenol component used to prepare the Mannich additive may be substituted with 0 to 4 groups on the aromatic ring (in addition to the phenol OH). For example it may be a hydrocarbyl-substituted cresol. Most preferably the phenol component is a mono-substituted phenol. Preferably it is a hydrocarbyl substituted phenol. Preferred hydrocarbyl substituents are alkyl substituents having 4 to 28 carbon atoms, especially 10 to 14 carbon atoms. Other preferred hydrocarbyl substituents are polyalkenyl substituents, such as polyisobutenyl substituents having a number average molecular weight of from 400 to 2500, for example from 500 to 1500.

In some embodiments the diesel fuel composition of the present invention comprises from 1 to 500 ppm, preferably 50 to 250 ppm of the additive of the present invention and from 1 to 500 ppm, preferably 50 to 250 ppm of a Mannich additive (ii).

In some embodiments the diesel fuel composition further comprises (iii) the reaction product of a carboxylic acid-derived acylating agent and an amine.

These may also be referred to herein in general as acylated nitrogen-containing compounds.

Suitable acylated nitrogen-containing compounds may be made by reacting a carboxylic acid acylating agent with an amine and are known to those skilled in the art.

Preferred carboxylic acid-derived acylating agents are polyisobutenyl succinic anhydrides. These compounds are commonly referred to as "PIBSAs" and are known to the person skilled in the art.

Conventional polyisobutenes and so-called "highly-reactive" polyisobutenes are suitable for use in the invention.

Especially preferred PIBSAs are those having a PIB molecular weight (Mn) of from 300 to 2800, preferably from 450 to 2300, more preferably from 500 to 1300.

In preferred embodiments the reaction product of the carboxylic acid derived acylating agent and an amine includes at least one primary or secondary amine group.

A preferred acylated nitrogen-containing compound for use herein is prepared by reacting a poly(isobutene)-substituted succinic acid-derived acylating agent (e.g., anhydride, acid, ester, etc.) wherein the poly(isobutene) substituent has a number average molecular weight (Mn) of between 170 to 2800 with a mixture of ethylene polyamines having 2 to about 9 amino nitrogen atoms, preferably about 2 to about 8 nitrogen atoms, per ethylene polyamine and about 1 to about 8 ethylene groups. These acylated nitrogen compounds are suitably formed by the reaction of a molar ratio of acylating agent:amino compound of from 10:1 to 1:10, preferably from 5:1 to 1:5, more preferably from 2:1 to 1:2 and most preferably from 2:1 to 1:1. In especially preferred embodiments, the acylated nitrogen compounds are formed by the reaction of acylating agent to amino compound in a molar ratio of from 1.8:1 to 1:1.2, preferably from 1.6:1 to 1:1.2, more preferably from 1.4:1 to 1:1.1 and most preferably from 1.2:1 to 1:1. Acylated amino compounds of this type and their preparation are well known to those skilled in the art and are described in for example EP0565285 and US5925151.

In some preferred embodiments the composition comprises a detergent of the type formed by the reaction of a polyisobutene-substituted succinic acid-derived acylating agent and a polyethylene polyamine. Suitable compounds are, for example, described in WO2009/040583.

In some embodiments the diesel fuel composition of the present invention comprises from 1 to 500 ppm, preferably 50 to 250 ppm of the additive of the present invention and from 1 to 500 ppm, preferably 50 to 250 ppm of an additive which is the reaction product of an acylating agent and an amine (iii).

In some embodiments the diesel fuel composition comprises (iv) the reaction product of a carboxylic acid-derived acylating agent and hydrazine.

Suitably the additive comprises the reaction product between a hydrocarbyl-substituted succinic acid or anhydride and hydrazine.

Preferably, the hydrocarbyl group of the hydrocarbyl-substituted succinic acid or anhydride comprises a $C_8$-$C_{36}$ group, preferably a $C_8$-$C_{18}$ group. Alternatively, the hydrocarbyl group may be a polyisobutylene group with a number average molecular weight of between 200 and 2500, preferably between 800 and 1200.

Hydrazine has the formula $NH_2$—$NH_2$ Hydrazine may be hydrated or non-hydrated. Hydrazine monohydrate is preferred.

The reaction between the hydrocarbyl-substituted succinic acid or anhydride and hydrazine produces a variety of products, such as is disclosed in US 2008/0060259.

In some embodiments the diesel fuel composition further comprises (v) a salt formed by the reaction of a carboxylic acid with di-n-butylamine or tri-n-butylamine. Exemplary compounds of this type are described in US 2008/0060608.

Such additives may suitably be the di-n-butylamine or tri-n-butylamine salt of a fatty acid of the formula $[R'(COOH)_x]_y$, where each R' is a independently a hydrocarbon group of between 2 and 45 carbon atoms, and x is an integer between 1 and 4.

In a preferred embodiment, the carboxylic acid comprises tall oil fatty acid (TOFA).

Further preferred features of additives of this type are described in EP1900795.

In some embodiments the diesel fuel composition further comprises (vi) the reaction product of a hydrocarbyl-substituted dicarboxylic acid or anhydride and an amine compound or salt which product comprises at least one amino triazole group.

Further preferred features of additive compounds of this type are as defined in US2009/0282731.

In some embodiments the diesel fuel composition further comprises (vii) a substituted polyaromatic detergent additive.

One preferred compound of this type is the reaction product of an ethoxylated naphthol and paraformaldehyde which is then reacted with a hydrocarbyl substituted acylating agent.

Further preferred features of these detergents are described in EP1884556.

In some embodiments the diesel fuel composition further comprises (viii) a partial ester of a substituted succinic acid.

Preferred compounds of this type are ester compounds which are the reaction product of a hydrocarbyl substituted succinic acid or a hydrocarbyl substituted succinic anhydride and an alcohol of formula $H—(OR)_n—OR^1$, wherein R is an optionally substituted alkylene group; $R^1$ is hydrogen or an optionally substituted hydrocarbyl group, and n is 0 or a positive integer; wherein n is not 0 when $R^1$ is hydrogen.

Further preferred features of these detergents are described in the applicant's copending applications WO2018/178680, WO2018/178678, WO2018/178695 and WO2018/178674.

The present inventors have surprisingly found that the combination of the first additive (i) and the second additive (ii) as defined herein significantly improve the low temperature properties of diesel fuels, including those which contain a biodiesel and/or renewable diesel component. In particular these additives improve the performance of fuels in the low temperature flow test.

According to a third aspect of the present invention there is provided a method of improving the lower temperature flow properties of a diesel fuel composition, the method comprising admixing into the composition:

a first additive (i) comprising one or more of:

(a) the reaction product of a polycarboxylic acid having at least one tertiary amino group and a primary or secondary amine;

(b) the reaction product of an α, β dicarboxylic acid or a derivative thereof and a primary amine; and (c) the reaction product of a polyamine and a fatty acid; and a second additive (ii) which is a terpolymer obtained by reacting monomers of:

(x) an α-olefin;

(y) an ester of an unsaturated alcohol; and (z) a third monomer different to (x) and (y) comprising an alkene functional group.

According to a fourth aspect of the present invention there is provided the use of the combination of:

a first additive (i) comprising one or more of:

(a) the reaction product of a polycarboxylic acid having at least one tertiary amino group and a primary or secondary amine;

(b) the reaction product of an α, β dicarboxylic acid or a derivative thereof and a primary amine; and (c) the reaction product of a polyamine and a fatty acid; and a second additive (ii) which is a terpolymer obtained by reacting monomers of:

(x) an α-olefin;

(y) an ester of an unsaturated alcohol; and (z) a third monomer different to (x) and (y) comprising an alkene functional group to improve the low temperature properties of a diesel fuel composition.

Preferred aspect of the third and fourth aspects of the present invention are described in relation to the first and second aspects. Further preferred features of the third and fourth aspects will now be described.

Preferably the method and use of the third and fourth aspects improves the low temperature properties of the diesel fuel composition as measured in the low temperature flow test (LTFT test). This test is described in example 3 and is defined in ASTM D4539 or CAN CGSB-3.0, no. 140.1-2017.

In this test 200 mL of fuel is cooled at a rate of 1° C./hour, beginning at least 10° C. above the measured cloud point of the fuel. At 1° C. intervals, measured from a reference sample in the same cooling medium/chamber, the sample of fuel is filtered at 20 kPa across a 17 μm stainless steel twill Dutch weave filter into a receiving beaker. If 180 mL (or more) of fuel is filtered within 60 seconds this is noted as a "Pass". If 60 seconds elapse and 180 mL of fuel (90% of the total volume) has not passed to the receiving beaker, this is noted as a "Fail". The LTFT temperature is the last temperature at which a "Pass" is followed on the subsequent 1° C. test temperature by a "Fail". Note that a sample provides a single data point and is not used for iterative test points.

The ability of an additive to improve the low temperature properties of a fuel in this test may be measured by considering the degree to which the LTFT is depressed compared with an otherwise identical fuel except for the presence of that additive.

Preferably the method and use of the present invention provide an LTFT depression of at least 2° C., preferably at least 3° C., more preferably at least 4° C. In some embodiments the method and use of the present invention provide an LTFT depression of more than 5° C., for example more than 7° C., or more than 8° C. In some embodiments the method and use of the present invention may provide an LTFT depression of more than 10° C.

Preferably the method and use of the present invention provide an LTFT depression of at least 3° C., preferably at least 5° C., more preferably at least 8° C. in a diesel fuel composition comprising mineral diesel and from 1 to 30 vol %, preferably from 1 to 20 vol %, more preferably from 1 to 10 vol % of a fuel selected from biodiesel, renewable diesel and mixtures thereof.

Preferably the method and use of the present invention provide an LTFT depression of at least 3° C., preferably at least 5° C., more preferably at least 8° C. in a diesel fuel composition comprising mineral diesel and from 1 to 30 vol %, preferably from 1 to 20 vol %, more preferably from 1 to 10 vol % biodiesel.

Preferably the method and use of the present invention provide an LTFT depression of at least 3° C., preferably at least 5° C., more preferably at least 8° C. in a diesel fuel composition comprising mineral diesel and from 1 to 30 vol %, preferably from 1 to 20 vol %, more preferably from 1 to 10 vol % renewable diesel.

The invention will now be further described with reference to the following non-limiting examples.

EXAMPLE 1

An additive composition was prepared comprising the following components:

| Composition 1 | wt % |
|---|---|
| Additive A | 38.2 |
| Additive B | 6.2 |
| Aromatic solvents including naphthalene | 6.2 |
| Xylene | 49.4 |

Additive A is a terpolymer comprising 85 mol % ethylene, 10 mol % vinyl acetate and 5 mol % 2-ethylhexylacrylate.

The molecular weight analysis of additive A is as follows:

| $M_n$ | $M_w$ | $M_p$ | $M_z$ | $M_{z+1}$ | PD |
|---|---|---|---|---|---|
| 4,006 | 8,368 | 8,055 | 15,343 | 23,586 | 2.06 |

Additive B comprises 72 wt % of an amide of EDTA and a Cm to Cm dialkyl amine; maleic acid tridecyl amide; and the reaction product of diethylene triamine and oleic acid.

EXAMPLE 2

Mineral diesel fuels were sourced having the following characteristics:

| | Fuel A | Fuel B | Fuel C | Fuel D | Fuel E | Fuel F |
|---|---|---|---|---|---|---|
| IBP | 118.6 | 93.6 | 97.5 | 120.7 | 117.6 | 96.8 |
| T90 | 343.3 | 351.6 | 331.1 | 328.7 | 354.6 | 319.5 |
| T95 | 357.9 | 370.8 | 350.6 | 347.8 | 372.3 | 352.6 |
| FBP | 400.6 | 412.0 | 399.3 | 381.9 | 418.6 | 376.2 |
| n-paraffin content (wt %) | 6.093 | 7.779 | 9.279 | 6.970 | 7.858 | 12.267 |
| Density at 15° C. ($gcm^{-3}$) | 0.847 | 0.850 | 0.845 | 0.844 | 0.855 | 0.838 |

| | Fuel G | Fuel H | Fuel I | Fuel J | Fuel K | Fuel L |
|---|---|---|---|---|---|---|
| IBP | 102.5 | 100.8 | 106.9 | 126.6 | 125.4 | 105.5 |
| T90 | 337.8 | 331.3 | 322.4 | 344.6 | 330.6 | 327.9 |
| T95 | 354.7 | 353.8 | 339.5 | 361.6 | 350.8 | 345.3 |
| FBP | 390.1 | 382.3 | 363.4 | 406.9 | 407.5 | 395.6 |
| n-paraffin content (wt %) | 8.918 | 10.616 | 5.631 | 5.910 | 5.899 | 7.703 |
| Density at 15° C. ($gcm^{-3}$) | 0.859 | 0.849 | 0.854 | 0.855 | 0.850 | 0.848 |

All of these mineral diesel fuels had a sulfur content of less than 50 ppm by weight and complied with ASTM D975 or CAN CGSB 5.517.

EXAMPLE 3

The additive of example 1 was dosed into various fuels including those listed in example 2, and blends thereof with biodiesel and/or renewable diesel.

The biodiesel was compliant with ASTM D6751 and CAN CGSB-3.524

The renewable diesel contained 12.15% n-paraffins and had a density of 0.78 $gcm^{-3}$.

These fuels were then tested according to the LTFT test method set out below, and the results are in table 1.

LTFT Test Method 200 mL of fuel was cooled at a rate of 1° C./hour, beginning at least 10° C. above the measured cloud point of the fuel. At 1° C. intervals, measured from a reference sample in the same cooling medium/chamber, the sample of fuel was filtered at 20 kPa across a 17 μm stainless steel twill Dutch weave filter into a receiving beaker. If 180 mL (or more) of fuel is filtered within 60 seconds this is noted as a "Pass". If 60 seconds elapse and 180 mL of fuel (90% of the total volume) has not passed to the receiving beaker, this is noted as a "Fail". The LTFT temperature is the last temperature at which a "Pass" is followed on the subsequent 1° C. test temperature by a "Fail".

TABLE 1

| Mineral fuel | % vol mineral | % vol biodiesel | % vol renewable | Treat rate additive ppm by volume | LTFT (° C.) |
|---|---|---|---|---|---|
| A | 95 | 5 | 0 | 0 | −24 |
| A | 95 | 5 | 0 | 250 | −26 |
| A | 95 | 5 | 0 | 500 | −29 |
| B | 95 | 5 | 0 | 0 | −20 |
| B | 95 | 5 | 0 | 500 | −24 |
| B | 95 | 5 | 0 | 1000 | −28 |
| C | 95 | 5 | 0 | 0 | −24 |
| C | 95 | 5 | 0 | 500 | −32 |
| D | 98 | 2 | 0 | 0 | −41 |
| D | 98 | 2 | 0 | 1250 | −48 |

TABLE 1-continued

| Mineral fuel | % vol mineral | % vol biodiesel | % vol renewable | Treat rate additive ppm by volume | LTFT (° C.) |
|---|---|---|---|---|---|
| D | 95 | 5 | 0 | 0 | −40 |
| D | 95 | 5 | 0 | 750 | −45 |
| E | 98 | 2 | 0 | 0 | −23 |
| E | 98 | 2 | 0 | 1000 | −33 |
| E | 95 | 5 | 0 | 0 | −25 |
| E | 95 | 5 | 0 | 1000 | −34 |
| F | 100 | 0 | 0 | 0 | −34 |
| F | 100 | 0 | 0 | 1500 | −48 |
| G | 100 | 0 | 0 | 0 | −25 |
| G | 100 | 0 | 0 | 750 | −35 |

TABLE 1-continued

| Mineral fuel | % vol mineral | % vol biodiesel | % vol renewable | Treat rate additive ppm by volume | LTFT (° C.) |
|---|---|---|---|---|---|
| H | 100 | 0 | 0 | 0 | −28 |
| H | 100 | 0 | 0 | 1000 | −41 |
| I | 98 | 2 | 0 | 0 | −37 |
| I | 98 | 2 | 0 | 500 | −43 |
| J | 70 | 0 | 30 | 0 | −25 |
| J | 70 | 0 | 30 | 2000 | −30 |
| K | 90 | 10 | 0 | 0 | −37 |
| K | 90 | 10 | 0 | 1500 | −43 |
| K | 85.5 | 4.5 | 10 | 0 | −34 |
| K | 85.5 | 4.5 | 10 | 900 | −39 |
| K | 85.5 | 4.5 | 10 | 1900 | −42 |
| L | 90 | 10 | 0 | 0 | −28 |
| L | 90 | 10 | 0 | 1000 | −41 |

EXAMPLE 4

An additive composition was prepared comprising the following components:

| Composition 2 | wt % |
|---|---|
| Additive A | 38.2 |
| Additive D | 6.2 |
| Aromatic solvents including naphthalene | 2.5 |
| Xylene | 53.1 |

Additive D comprises 71 wt % of the reaction product of ethylenediamine tetra(acetic acid) (EDTA) and 4 eq of di(hydrogenated tallow)amine.

EXAMPLE 5

An additive composition was prepared comprising the following components:

| Composition 3 | wt % |
|---|---|
| Additive E | 38.2 |
| Additive B | 6.2 |
| Aromatic solvents including naphthalene | 6.2 |
| Xylene | 49.4 |

Additive E is a terpolymer prepared from ethylene (~86 mol %), vinyl acetate (~12 mol %) and vinyl 2-ethylhexanoate (— 2 mol %) and having a number average molecular weight (Mn) 3,200.

EXAMPLE 6

An additive composition was prepared comprising the following components:

| Composition 4 | wt % |
|---|---|
| Additive F | 38.2 |
| Additive B | 6.2 |
| Aromatic solvents including naphthalene | 6.2 |
| Xylene | 49.4 |

Additive F is a terpolymer prepared from ethylene (~85 mol %), vinyl acetate (~14 mol %) and vinyl neodecanoate (~1 mol %) and having a number average molecular weight (Mn)~4,200.

EXAMPLE 7

An additive composition was prepared comprising the following components:

| Composition 5 | wt % |
|---|---|
| Additive A | 38.2 |
| Additive G | 6.2 |
| Aromatic solvents including naphthalene | 18.9 |
| Xylene | 36.7 |

Additive G comprises 25 wt % of the reaction product of phthalic anhydride and 2 eq of di(hydrogenated tallow) amine.

EXAMPLE 8 (COMPARATIVE)

An additive composition was prepared comprising the following components:

| Composition 6 | wt % |
|---|---|
| Additive B | 6.2 |
| Aromatic solvents including naphthalene | 44.4 |
| Xylene | 49.4 |

EXAMPLE 9

Further additised fuel compositions were tested according to the method of example 3. The results are shown in table 2.

TABLE 2

| Mineral fuel | % vol mineral | % vol bio-diesel | % vol renew-able | Additive composition | Treat rate additive ppm by volume | LTFT (° C.) |
|---|---|---|---|---|---|---|
| D | 95 | 5 | 0 | No additive | 0 | −40 |
| D | 95 | 5 | 0 | Example 1 | 750 | −45 |
| D | 95 | 5 | 0 | Example 8 (comparative) | 1000 | −38 |
| D | 95 | 5 | 0 | Example 4 | 1000 | −45 |
| D | 95 | 5 | 0 | Example 5 | 1000 | −45 |
| D | 95 | 5 | 0 | Example 6 | 1000 | −44 |
| D | 95 | 5 | 0 | Example 7 | 1000 | −45 |
| L | 90 | 10 | 0 | No additive | 0 | −28 |
| L | 90 | 10 | 0 | Example 1 | 1000 | −41 |
| L | 90 | 10 | 0 | Example 8 (comparative) | 1000 | −28 |
| L | 90 | 10 | 0 | Example 4 | 1000 | −38 |
| L | 90 | 10 | 0 | Example 5 | 1000 | −39 |
| L | 90 | 10 | 0 | Example 6 | 1000 | −44 |
| L | 90 | 10 | 0 | Example 7 | 1000 | −44 |

The invention claimed is:

1. A diesel fuel composition comprising a major proportion of a diesel fuel and:

from 50 to 5000 ppm of a first additive (i) comprising one or more of:

(a) the reaction product of a carboxylic acid selected from nitrilotriacetic acid, ethylenediamine tetraacetic acid and propylene-1,2-diamine tetraacetic acid and an amine selected from dioleylamine, dipalmitamine, dicoconut fatty amine, distearylamine, dibehenyl amine, ditallow fatty amine and hydrogenated ditallow fatty amine;

(b) the reaction product of maleic anhydride and an amine selected from coconut amine, tallow fatty amine, oleyl amine, arachidyl amine, tridecyl amine and behenyl amine; and (c) the reaction product of polyethylene polyamines having 2 to 6 nitrogen atoms and fatty acids having 16 to 20 carbon atoms; and from 50 to 5000 ppm of a second additive (ii) which is a terpolymer obtained by reacting monomers of:

(x) ethylene;

(y) vinyl or propenyl esters of C1 to C20 carboxylic acids; and (z) a third monomer different to (x) and (y) comprising an alkene functional group selected from:

an α-olefin;

an α,β unsaturated carboxylic acid or an ester thereof; and an ester of an unsaturated alcohol, wherein the diesel fuel comprises mineral diesel and at least 5 vol % of a renewable diesel fuel obtained by the hydrodeoxygenation of fats and oils; and wherein the diesel fuel composition has an improved performance in a low temperature flow test (as defined in ASTM D4539 or CAN CGSB-3.0, no. 140.1-2017) as compared to the same fuel without the first additive (i) and the second additive (ii).

2. A method of improving the lower temperature flow properties of a diesel fuel composition, the method comprising admixing into the composition:

from 50 to 5000 ppm of a first additive (i) comprising one or more of:

(a) the reaction product of a carboxylic acid selected from nitrilotriacetic acid, ethylenediamine tetraacetic acid and propylene-1,2-diamine tetraacetic acid and an amine selected from dioleylamine, dipalmitamine, dicoconut fatty amine, distearylamine, dibehenyl amine, ditallow fatty amine and hydrogenated ditallow fatty amine;

(b) the reaction product of maleic anhydride and an amine selected from coconut amine, tallow fatty amine, oleyl amine, arachidyl amine, tridecyl amine and behenyl amine; and (c) the reaction product of polyethylene polyamines having 2 to 6 nitrogen atoms and fatty acids having 16 to 20 carbon atoms; and from 50 to 5000 ppm of a second additive (ii) which is a terpolymer obtained by reacting monomers of:

(x) ethylene;

(y) vinyl or propenyl esters of C1 to C20 carboxylic acids; and (z) a third monomer different to (x) and (y) comprising an alkene functional group selected from:

an α-olefin;

an α,β unsaturated carboxylic acid or an ester thereof; and an ester of an unsaturated alcohol, wherein the diesel fuel comprises mineral diesel and at least 5 vol % of a renewable diesel fuel obtained by the hydrodeoxygenation of fats and oils; and wherein the method provides an improved performance in a low temperature flow test (as defined in ASTM D4539 or CAN CGSB-3.0, no. 140.1-2017).

3. The diesel fuel composition of claim 1 wherein the first additive (i) comprises (a), (b) and (c).

4. The diesel fuel composition of claim 1 wherein monomer (y) is vinyl acetate.

5. The diesel fuel composition of claim 1 wherein monomer (z) is selected from propene, vinyl neononanoate, vinyl 2-ethylhexanoate and 2-ethylhexylacrylate.

6. The method of claim 2 which provides an LTFT depression of at least 2° C.

* * * * *